US010971289B2

(12) United States Patent
Nagata

(10) Patent No.: US 10,971,289 B2
(45) **Date of Patent: *Apr. 6, 2021**

(54) COMPOSITE R-FE-B SERIES RARE EARTH SINTERED MAGNET COMPRISING PR AND W

(71) Applicants: XIAMEN TUNGSTEN CO., LTD., Fujian (CN); Fujian Changting Golden Dragon Rare-Earth Co., Ltd., Fujian Province (CN)

(72) Inventor: Hiroshi Nagata, Tokyo (JP)

(73) Assignees: XIAMEN TUNGSTEN CO., LTD., Fujian (CN); Fujian Changting Golden Dragon Rare-Earth Co., Ltd, Fujian Province (CN)

( * ) Notice: Subject to any disclaimer, the term of this patent is extended or adjusted under 35 U.S.C. 154(b) by 135 days.

This patent is subject to a terminal disclaimer.

(21) Appl. No.: 15/763,508

(22) PCT Filed: Sep. 23, 2016

(86) PCT No.: PCT/CN2016/099861
§ 371 (c)(1),
(2) Date: Mar. 27, 2018

(87) PCT Pub. No.: WO2017/054674
PCT Pub. Date: Apr. 6, 2017

(65) Prior Publication Data

US 2018/0294081 A1 Oct. 11, 2018

(30) Foreign Application Priority Data

Sep. 28, 2015 (CN) ..... 201510625876.X
Sep. 18, 2016 (CN) ..... 201610827760.9

(51) Int. Cl.
*H01F 1/057* (2006.01)
*C22C 38/16* (2006.01)
(Continued)

(52) U.S. Cl.
CPC ..... *H01F 1/0577* (2013.01); *B22F 1/0011* (2013.01); *C22C 38/002* (2013.01);
(Continued)

(58) Field of Classification Search
None
See application file for complete search history.

(56) References Cited

U.S. PATENT DOCUMENTS 10,381,139 B2 * 8/2019 Nagata ..... C22C 38/10
10,468,168 B2 * 11/2019 Nagata ..... C22C 38/12
(Continued)

FOREIGN PATENT DOCUMENTS

CN 102956337 A 3/2013
CN 103093916 A * 5/2013
(Continued)

OTHER PUBLICATIONS

Machine translation of CN 103093916A. (Year: 2013).*
(Continued)

*Primary Examiner* — Xiaowei Su
(74) *Attorney, Agent, or Firm* — Cooper Legal Group, LLC

(57) ABSTRACT

Disclosed in the present invention is a composite R—Fe—B based rare-earth sintered magnet comprising Pr and W, wherein the rare-earth sintered magnet comprises an $R_2Fe_{14}B$ type main phase, and R is a rare-earth element comprising at least Pr, wherein the raw material components therein comprise more than or equal to 2 wt % of Pr and 0.0005 wt %-0.03 wt % of W; and the rare-earth sintered magnet is made through a process comprising the following
(Continued)

steps: preparing molten liquid of the raw material components into a rapidly quenched alloy; grinding the rapidly quenched alloy into fine powder; obtaining a shaped body from the fine powder by using a magnetic field; and sintering the shaped body. By adding a trace amount of W into the rare-earth sintered magnet, the heat resistance and thermal demagnetization performance of the Pr-containing magnet are improved.

17 Claims, 4 Drawing Sheets

(51) Int. Cl.

| | |
|---|---|
| ***C22C 38/12*** | (2006.01) |
| ***C22C 38/10*** | (2006.01) |
| ***B22F 9/04*** | (2006.01) |
| ***B22F 3/24*** | (2006.01) |
| ***B22F 1/00*** | (2006.01) |
| ***C22C 38/00*** | (2006.01) |
| ***H01F 41/02*** | (2006.01) |

(52) U.S. Cl.
CPC ..... *C22C 38/005* (2013.01); *C22C 38/10* (2013.01); *C22C 38/12* (2013.01); *C22C 38/16* (2013.01); *H01F 1/057* (2013.01); *H01F 41/0253* (2013.01); *B22F 9/04* (2013.01); *B22F 2301/355* (2013.01); *B22F 2304/10* (2013.01); *B22F 2998/10* (2013.01); *B22F 2999/00* (2013.01); *C22C 2202/02* (2013.01)

(56) References Cited

U.S. PATENT DOCUMENTS

| | | | | |
|---|---|---|---|---|
| 2007/0157998 | A1* | 7/2007 | Hirota | C22C 1/0441 148/302 |
| 2011/0095855 | A1 | 4/2011 | Kuniyoshi et al. | |
| 2011/0279205 | A1* | 11/2011 | Fukui | C22C 38/005 335/302 |
| 2012/0091844 | A1* | 4/2012 | Nakajima | H01F 1/0577 310/152 |
| 2013/0271248 | A1 | 10/2013 | Nagata et al. | |
| 2015/0017053 | A1* | 1/2015 | Shindo | H01F 1/0577 419/10 |
| 2015/0170810 | A1* | 6/2015 | Miwa | B22F 3/10 75/246 |
| 2015/0248954 | A1* | 9/2015 | Sun | C22C 38/16 148/102 |
| 2015/0364234 | A1* | 12/2015 | Nagata | C22C 38/02 419/28 |
| 2016/0042847 | A1* | 2/2016 | Nishiuchi | C22C 38/001 335/302 |
| 2019/0267166 | A1* | 8/2019 | Nagata | C22C 38/10 |

FOREIGN PATENT DOCUMENTS

| | | | | |
|---|---|---|---|---|
| CN | 103093916 | A | 5/2013 | |
| CN | 103878377 | A | 6/2014 | |
| EP | 3128521 | A1 | 2/2017 | |
| JP | H05339684 | A | 12/1993 | |
| JP | 2004006767 | A | 1/2004 | |
| JP | 2004296848 | A | 10/2004 | |
| JP | 2011021269 | A | 2/2011 | |
| TW | 201435094 | A | 9/2014 | |
| WO | 2007063969 | A1 | 6/2007 | |
| WO | 2013125075 | A1 | 8/2013 | |
| WO | WO-2014101855 | A1 * | 7/2014 | B22F 1/0003 |
| WO | WO-2015149685 | A1 * | 10/2015 | H01F 1/0577 |

OTHER PUBLICATIONS

Krasnov (Poroshikovaya Metallurgiya, 1966, vol. 38, No. 2, p. 79-83). (Year: 1966).*

International Search Report in international application No. PCT/CN2016/099861 dated Nov. 22, 2016 2 pgs.

* cited by examiner

COMPOSITE R-FE-B SERIES RARE EARTH SINTERED MAGNET COMPRISING PR AND W

TECHNICAL FIELD

The present invention relates to the technical field of magnet manufacture, and in particular, to a composite R—Fe—B based rare-earth sintered magnet comprising Pr and W.

BACKGROUND

Since the Nd—Fe—B magnet was invented in 1983, Pr, as a substituting element having basically the same properties as Nd, has attracted attention. However, the existing quantity of Pr in nature is low and has a comparatively higher price. Further, the oxidizing speed of metal Pr is faster than that of metal Nd. As a result, the value of Pr is not recognized by the industry and the application of Pr is restricted.

After entering the 1990s, progress was made in the utilization of a Pr—Nd (Didymium) alloy because relatively low-priced raw materials could be obtained when Pr—Nd is used as an intermediate material for refining. However, the application of the Pr—Nd alloy was limited to Magnetic Resonance Imaging (MRI) devices for which corrosion resistance is not to be considered and magnetic buckles which require exceptionally low costs. As compared with pure Nd raw materials, using the Pr—Nd (Didymium) alloy raw materials reduces the coercive force, square degree, and heat resistance of magnets, which has become common general knowledge in the industry.

Entering the 2000s, the low-priced Pr—Nd (Didymium) alloy attracted wide attention because the price of pure Nd metal rose high. To achieve the goal of low cost, studies were done to improve the purity of the Pr—Nd (Didymium) alloy and resolve the problem of low performance of Pr-comprising magnets.

In about 2005, the Pr—Nd (Didymium) alloy was used in China and substantially the same properties as magnets using pure Nd were obtained.

Entering the 2010s, the price of rare earth metals rose high and the Pr—Nd alloy attracted further attention because of its low price.

Now, magnet manufacturers in the world have started using the Pr—Nd alloy, further exploring its purity and developing its quality management. While the Pr—Nd alloy has reached high purity, the performance and corrosion resistance of magnets have been also improved. The improvement in corrosion resistance comes from the effects generated through the following: the decrease in impurities produced by the process of separation and refining, the decrease in mixed mineral waste residues and C impurities produced by the process of reduction of oxides and fluorides to metals.

Magnetocrystalline anisotropy of compound $Pr_2Fe_{14}B$ is about 1.2 times that of compound $Nd_2Fe_{14}B$. By using the Pr—Nd alloy, the coercive force and the heat resistance of magnets are possibly improved as well.

On the one hand, since 2000, the application of a uniform fine grinding method combining a quenching casting process (called strip casting method) and hydrogen decrepitation treatment has been developed, and the coercive force and heat resistance of magnets has been improved. On the other hand, the hermetical treatment that prevents the contamination caused by oxygen in the air, the most suitable application of lubricants/antioxidants, and the decrease of C contamination may further improve the comprehensive performance.

At present, the applicant strives to further improve Pr-containing Nd—Fe—B sintered magnets. As a result, when low-oxygen-content and low-C-content magnets are manufactured by using the latest Pr—Nd alloy and pure Pr metal, a problem that the growth of crystal grains occurs early, causing the abnormal growth of the grains with no improvement in coercive force and heat resistance.

SUMMARY

The purpose of the present invention is to overcome the defects in the prior art and provide a composite R—Fe—B based rare-earth sintered magnet comprising Pr and W, so as to solve the above-mentioned problems present in the prior art. By enabling a magnet alloy to comprise a trace amount of W, the problem that the grains abnormally grow is solved and magnets with improved coercive force and heat resistance are obtained.

A technical solution as follows is provided in the present invention.

A composite R—Fe—B based rare-earth sintered magnet comprising Pr and W, wherein the rare-earth sintered magnet comprises an $R_2Fe_{14}B$ type main phase, and R is a rare-earth element comprising at least Pr, wherein the raw material components therein comprise more than or equal to 2 wt % of Pr and 0.0005 wt %-0.03 wt % of W; and the rare-earth sintered magnet is made through a process comprising the following steps: preparing molten liquid of the raw material components into a rapidly quenched alloy; grinding the rapidly quenched alloy into fine powder; obtaining a shaped body from the fine powder by using a magnetic field; and sintering the shaped body.

In the present invention, wt % refers to percentage by weight.

Various rare-earth elements in rare-earth minerals coexist, and the costs in mining, separation and purification are high. If the rare earth element Pr which is relatively rich in rare earth minerals can be used with common Nd to manufacture the R—Fe—B based rare-earth sintered magnet, the cost of the rare-earth sintered magnet can be reduced; on the other hand, the rare earth resources can be comprehensively utilized.

Although Pr and Nd are in the same group of rare earth elements, they are different in the following several points (as illustrated in FIGS. 1, 2, 3, 4, and 5, wherein FIG. 1 is from a public report, and FIGS. 2, 3, 4, and 5 are all from software of Binary Alloy Phase Diagrams), and after casting, grinding, shaping, sintering, and heat treatment of raw material components of a rare-earth sintered magnet comprising Pr, sintered magnets can be obtained, which have performance differences from that of R—Fe—B magnets without Pr added.

After the raw material components of the rare-earth sintered magnet comprise Pr and W, the following subtle changes emerge.

1. Microscopic structures of a magnet alloy subtly change.

Since the melting point of Pr is low, the casting structures would change. Besides, since the vapor pressure of Pr is lower than that of Nd, the volatiles are fewer during smelting and cooling after smelting, and the thermal contact with a copper roller has improved.

2. The decrepitation performance of hydrogen subtly changes.

When Nd is compared with Pr, the composition rate of hydride and the number of hydride phases are different. As a result, the rapidly quenched alloy of Pr—Fe—B—W is easier to crack.

3. Subtle changes happen during grinding.

As a result of 1 and 2, during grinding, a cracked crystallization surface, the distribution of impurity phase and the like change. This is because Pr is more active than Nd and preferentially reacts with oxygen, carbon and the like. As a result, powder with higher content of Pr oxides and Pr carbides in a grain boundary is obtained.

4. Subtle changes happen during sintering.

As a result of 1, 2, and 3, the fine powder is different; and since the melting points of Nd and Pr are different, temperature at which liquid phase occurs during sintering, wetness of crystal surface of the main phase and the like subtly change, causing different sintering performance. In addition, since the components of the grain boundary phase are different, the grain boundary phase structures of the finally obtained magnets are also different, having a great influence on the coercive force, square degree and heat resistance of $R_2Fe_{14}B$ based sintered magnets having a structure in which coercive force is induced by nucleation mechanism.

The coercive force of the Pr—Fe—B based rare-earth sintered magnet is controlled by a nucleation field of a magnetization reversal domain; the magnetization reversal process is not uniform, wherein magnetization reversal is performed to coarse grains firstly, and the fine grains secondly. Therefore, for Pr-containing magnets, by adding an extremely trace amount of W, the size, shape and surface state of the grains are adjusted through the pinning effect of the trace amount of W; the temperature dependency of Pr is weakened, and the heat resistance and square degree of the magnets are improved.

Since Pr has higher temperature dependency than that of Nd, the present invention tries to improve the heat resistance of Pr-containing magnets by adding a trace amount of W (0.0005 wt %-0.03 wt %). After being added, the trace amount of W is segregated towards the crystal grain boundary; consequently the Pr—Fe—B—W based magnet or Pr—Nd—Fe—B—W based magnet is different from the Nd—Fe—B—W based magnet; better magnet performance can be obtained and thus the present invention can be achieved. When the Pr—Fe—B—W based magnet or Pr—Nd—Fe—B—W based magnet is compared with the Nd—Fe—B—W based magnet, magnet performance in Hcj, SQ, and heat resistance are all improved.

In addition, W, as a rigid element, can harden a flexible grain boundary, thereby having a lubrication function and achieving the effect of improving the orientation degree as well.

It needs to be stated that the heat resistance of magnets (resistance to thermal demagnetization) is a very complex phenomenon. In textbooks, the heat resistance is in inverse proportion to magnetization and is in proportion to coercive force.

However, in reality, from the macroscopic angle, the coercive force in the magnet is not uniform; and the coercive force on the magnet surface and inside the magnet is not uniform, either. Further, from the microscopic angle, the microscopic structures are different. These situations that the distribution of the coercive force is not uniform are represented by a square degree (SQ) under most circumstances.

However, in actual use, the causes of thermal demagnetization of magnets are more complex and cannot be fully expressed by solely using the SQ index. SQ is a determined value obtained by forcibly applying a demagnetizing field in a determination process. However, in actual application, the thermal demagnetization of magnets is a demagnetization situation which is not caused by an external magnetic field, but mostly is caused by a demagnetizing field produced by the magnet itself. The demagnetizing field produced by the magnet itself has a close connection with the shape and the microscopic structure of the magnet. For example, the magnet with a poor square degree (SQ) may also have good thermal demagnetization performance. Therefore, as a conclusion, in the present invention, the thermal demagnetization of the magnet is determined in actual use environment, and cannot be deduced simply by using values of Hcj and SQ.

To view from the source of W, as one of rare-earth sintered magnet preparation methods that are adopted at present, an electrolytic cell is used, in which a cylindrical graphite crucible serves as an anode; a tungsten (W) rod configured in an axial line of the graphite crucible serves as a cathode; and a rare-earth metal is collected by a tungsten crucible at the bottom of the graphite crucible. During the above process of preparing the rare-earth element (for example Nd), a small amount of W would be inevitably mixed therein. In practice, another metal such as molybdenum (Mo) with a high melting point may also serve as the cathode, and by collecting a rare-earth metal using a molybdenum crucible, a rare-earth element which contains no W is obtained.

Therefore, in the present invention, W may be an impurity of a metal raw material (such as a pure iron, a rare-earth metal or B); and the raw material used in the present invention is selected based on the content of the impurity in the raw material. In practice, a raw material which does not contain W may also be selected, and a metal raw material of W is added as described in the present invention. In short, as long as the raw material of the rare-earth sintered magnet comprises the necessary amount of W, the source of W does not matter. Table 1 shows examples of the content of the element W in metal Nd from different production areas and different workshops.

TABLE 1

Content of Element W in Metal Nd from Different Production Areas and Different Workshops

| Metal Nd Raw material | Purity | W Concentration (ppm) |
|---|---|---|
| A | 2N5 | 0 |
| B | 2N5 | 1 |
| C | 2N5 | 11 |
| D | 2N5 | 28 |
| E | 2N5 | 89 |
| F | 2N5 | 150 |
| G | 2N5 | 251 |

*2N5 in Table 1 represents 99.5%.

In the present invention, generally the amount ranging from 28 wt %-33 wt % for R and from 0.8 wt %-1.3 wt % for B belongs to the conventional selections in the industry; therefore, in specific implementations, the amount ranges of R and B are not tested and verified.

In recommended implementation modes, the amount of Pr is 2 wt %-10 wt % of the raw material components.

In recommended implementation modes, R is a rare earth element comprising at least Nd and Pr.

In recommended implementation modes, the amount of oxygen in the rare-earth sintered magnet is less than or equal to 2000 ppm. By completing all manufacture processes of a magnet in a low-oxygen environment, a low-oxygen-content rare-earth sintered magnet with oxygen content less than or equal to 2000 ppm has very good magnetic performance; and the addition of the trace amount of W has a very significant effect on the improvement of the Hcj, square degree and heat resistance of the low-oxygen-content Pr-containing magnet. It should be noted that the process for manufacturing the magnet in the low oxygen environment belongs to the conventional technology; and all embodiments of the present invention are implemented with the process for manufacturing the magnet in the low oxygen environment, which are not described in detail herein.

In addition, during the manufacturing process, a small amount of C, N and other impurities are inevitably introduced. In preferred implementation modes, the amount of C is preferably controlled to be less than or equal to 0.2 wt %, and more preferably less than or equal to 0.1 wt %, and the amount of N is controlled to be less than or equal to 0.05 wt %.

In recommended implementation modes, the amount of oxygen in the rare-earth sintered magnet is less than 1000 ppm. The crystal grain of the Pr-containing magnet with oxygen content less than 1000 ppm grows abnormally easily. As a result, the Hcj, square degree, and heat resistance of the magnet becomes poor. The addition of the trace amount of W has a very significant effect on the improvement of the Hcj, square degree, and heat resistance of the low-oxygen-content Pr-containing magnet.

In recommended implementation modes, the raw material components further comprise less than or equal to 2.0 wt % of at least one additive element selected from a group consisting of Zr, Co, V, Mo, Zn, Ga, Nb, Sn, Sb, Hf, Bi, Ni, Ti, Cr, Si, S, and P, less than or equal to 0.8 wt % of Cu, less than or equal to 0.8 wt % of Al, and the balance of Fe.

In recommended implementation modes, the rapidly quenched alloy is obtained by cooling the molten liquid of the raw material components at a cooling speed of more than or equal to $10^{2\circ}$ C./s and less than or equal to $10^{4\circ}$ C./s by using a strip casting method, the step of grinding the rapidly quenched alloy into fine powder comprises coarse grinding and fine grinding; the coarse grinding is a step of performing hydrogen decrepitation on the rapidly quenched alloy to obtain coarse powder, and the fine grinding is a step of performing jet milling on the coarse powder.

In recommended implementation modes, the average crystalline grain size of the rare-earth sintered magnet is 2-8 microns.

The effect brought by uniform precipitation of W in the crystal grain boundary is obviously more sensitive to the magnet with more crystal grain boundaries and a smaller crystalline grain size; and this is a feature of an R based sintered magnet having a nucleation-induced coercive force mechanism.

For the R based sintered magnet with an average crystalline grain size of 2-8 microns, after the compound addition of Pr and W, through the uniform precipitation effect of the trace amount of W, the temperature dependency of Pr is weakened; the Curie temperature (Tc), magnetic anisotropy, Hcj, and square degree are improved; and the heat resistance and thermal demagnetization are improved.

It is very difficult to manufacture sintered magnets having tiny structures with an average crystalline grain size less than 2 microns. This is because fine powder for manufacturing the R based sintered magnet has a grain size less than 2 microns, which easily forms an agglomeration, and has a poor formability, causing a sharp reduction in the orientation degree and Br. Besides, since a green density is not fully improved, a magnetic flux density may also be sharply reduced and the magnet having good heat resistance cannot be manufactured.

However, the number of crystal grain boundaries of the sintered magnet with an average crystalline grain size more than 8 microns is very small; and the effect of improving the coercive force and heat resistance through the compound addition with Pr and W is not obvious, which is due to the relative poor effect brought by the uniform precipitation of W in the grain boundaries.

In recommended implementation modes, the average crystalline grain size of the rare-earth sintered magnet is 4.6-5.8 microns.

In recommended implementation modes, the raw material components comprise 0.1 wt %-0.8 wt % of Cu. The increase in a low-melting-point liquid phase improves the distribution of W. In the present invention, W is quite uniformly distributed in the grain boundaries, the distribution range therein exceeds that of R-enriched phase; and the entire R-enriched phase is substantially covered, which can be considered as evidence that W exerts a pinning effect and obstructs grains to grow. Further, the effects of W in refining the grains, improving a grain size distribution and weakening the temperature dependency of Pr can be fully exerted.

In recommended implementation modes, the raw material components comprise 0.1 wt %-0.8 wt % of Al.

In recommended implementation modes, the raw material components comprise 0.3 wt %-2.0 wt % of at least one additive element selected from a group consisting of Zr, Co, V, Mo, Zn, Ga, Nb, Sn, Sb, Hf, Bi, Ni, Ti, Cr, Si, S, and P.

In recommended implementation modes, the amount of B is preferably 0.8 wt %-0.92 wt %. When the amount of B is less than 0.92 wt %, the crystal structure of the rapidly quenched alloy sheet can be more easily manufactured and can be more easily manufactured into fine powder. For the Pr-containing magnet, its coercive force can be effectively improved by refining the grains and improving the grain size distribution. However, when the amount of B is less than 0.8 wt %, the crystal structure of the rapidly quenched alloy sheet may become too fine, and amorphous phases are introduced, causing the decrease in the magnetic flux density of Br.

Another technical solution as follows is provided in the present invention.

A composite R—Fe—B based rare-earth sintered magnet comprising Pr and W, wherein the rare-earth sintered magnet comprises an $R_2Fe_{14}B$ type main phase, and R is a rare-earth element comprising at least Pr, wherein the components therein comprise more than or equal to 1.9 wt % of Pr and 0.0005 wt %-0.03 wt % of W; and the rare-earth sintered magnet is made through a process comprising the following steps: preparing molten liquid of the raw material components into a rapidly quenched alloy; grinding the rapidly quenched alloy into fine powder; obtaining a shaped body from the fine powder by using a magnetic field; and sintering the shaped body.

Still another technical solution as follows is provided in the present invention.

A composite R—Fe—B based rare-earth sintered magnet comprising Pr and W, the rare-earth sintered magnet comprises an $R_2Fe_{14}B$ type main phase and comprises the following raw material components:

28 wt %-33 wt % of R, which is a rare-earth element comprising at least Pr, wherein an amount of Pr is more than or equal to 2 wt % of the raw material components; 0.8 wt %-1.3 wt % of B; 0.0005 wt %-0.03 wt % of W; and the balance of T and inevitable impurities, wherein T is an element mainly comprises Fe and less than or equal to 18 wt % of Co; and an amount of oxygen in the rare-earth sintered magnet is less than or equal to 2000 ppm.

In recommended implementation modes, T comprises less than or equal to 2.0 wt % of at least one additive element selected from Zr, V, Mo, Zn, Ga, Nb, Sn, Sb, Hf, Bi, Ni, Ti, Cr, Si, S, and P, and less than or equal to 0.8 wt % of Cu, less than or equal to 0.8 wt % of Al.

In recommended implementation modes, T comprises 0.1 wt %-0.8 wt % of Cu, 0.1 wt %-0.8 wt % of Al.

It needs to be stated that the numerical ranges disclosed in the present invention comprise all point values in the ranges.

DETAILED DESCRIPTION OF THE EMBODIMENTS

Figure 1:
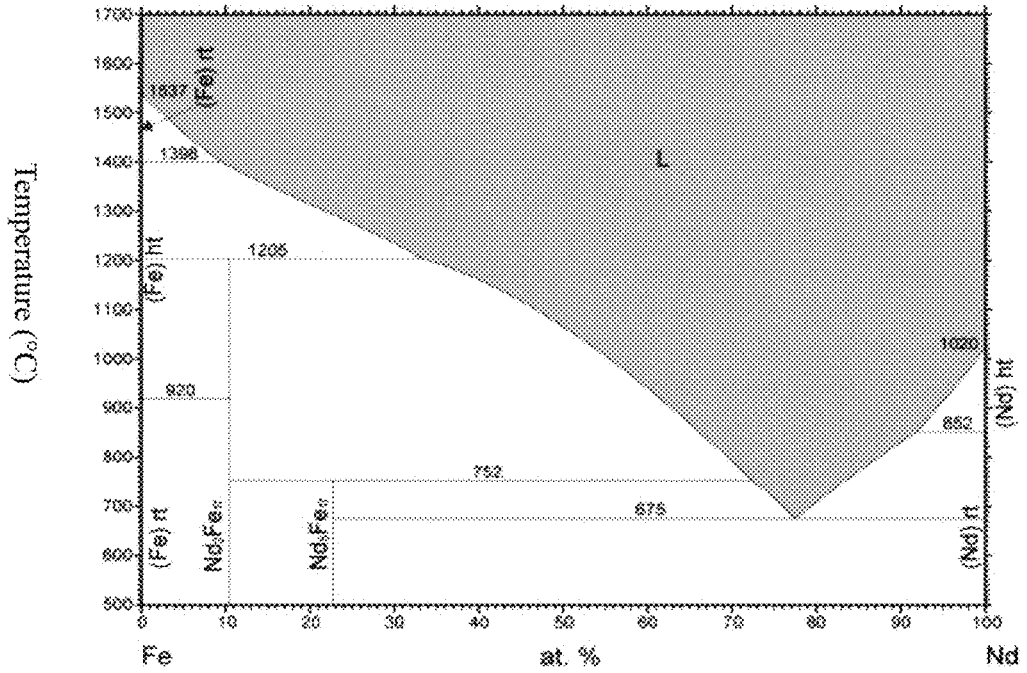
FIG. 1 illustrates a binary phase diagram of Nd—Fe.
Figure 2:
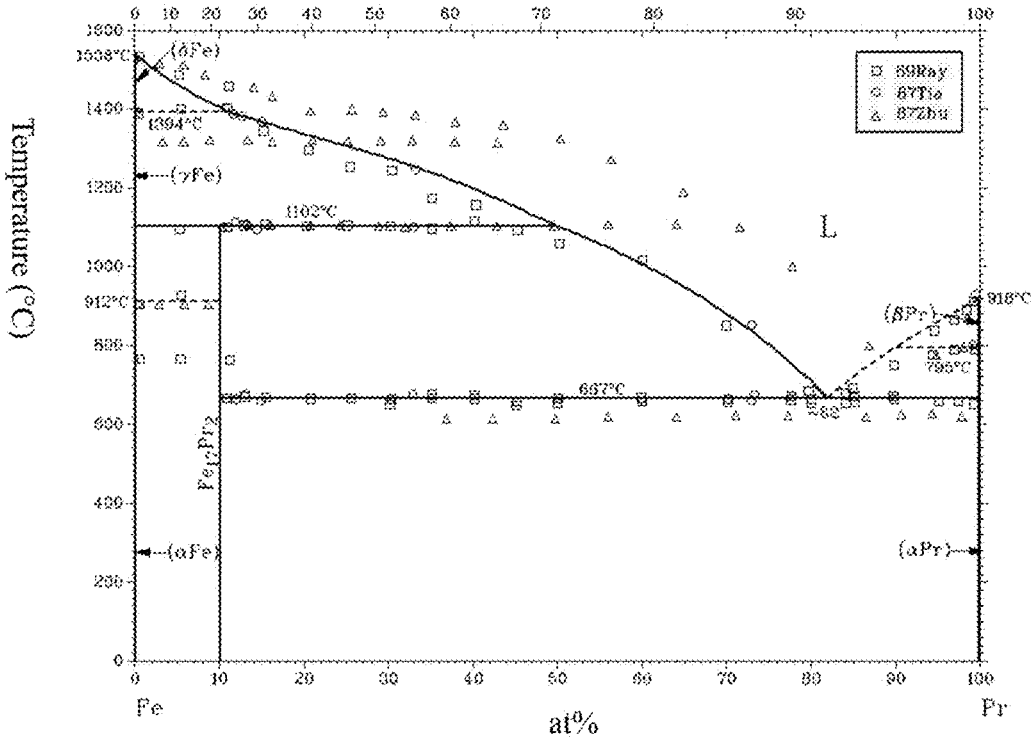
FIG. 2 illustrates a binary phase diagram of Pr—Fe.
Figure 3:
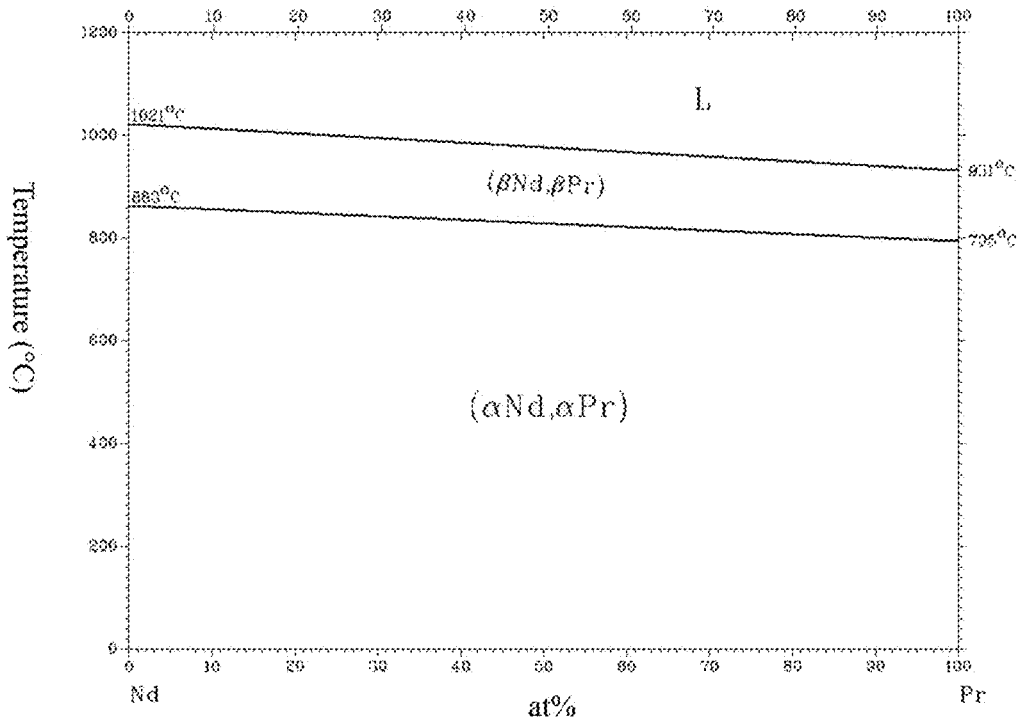
FIG. 3 illustrates a binary phase diagram of Pr—Nd.
Figure 4:
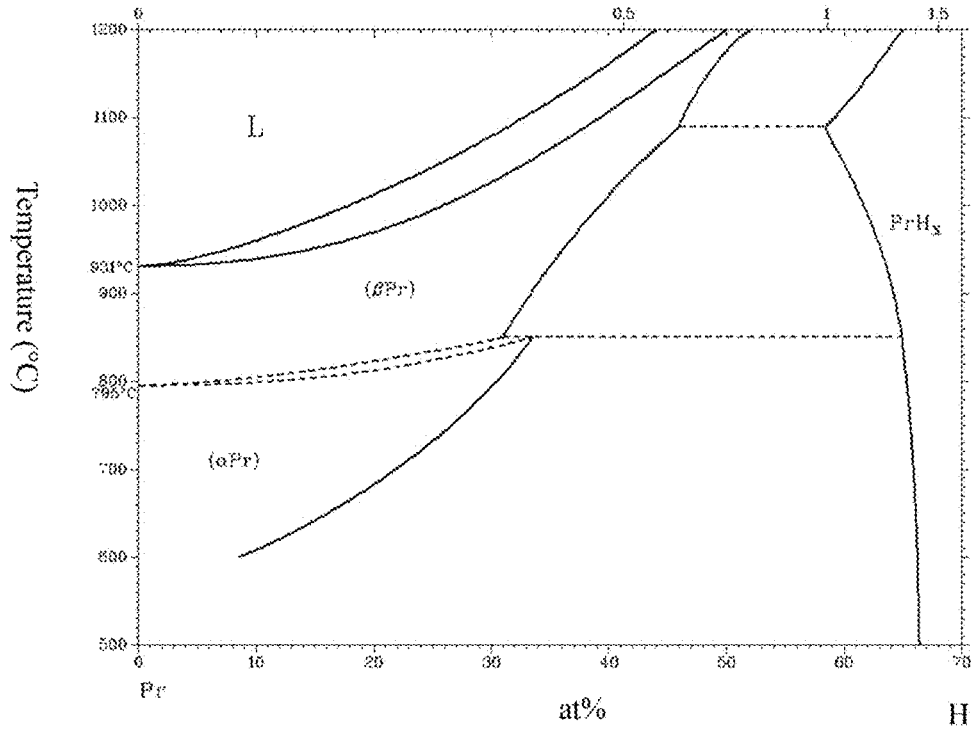
FIG. 4 illustrates a binary phase diagram of Pr—H.
Figure 5:
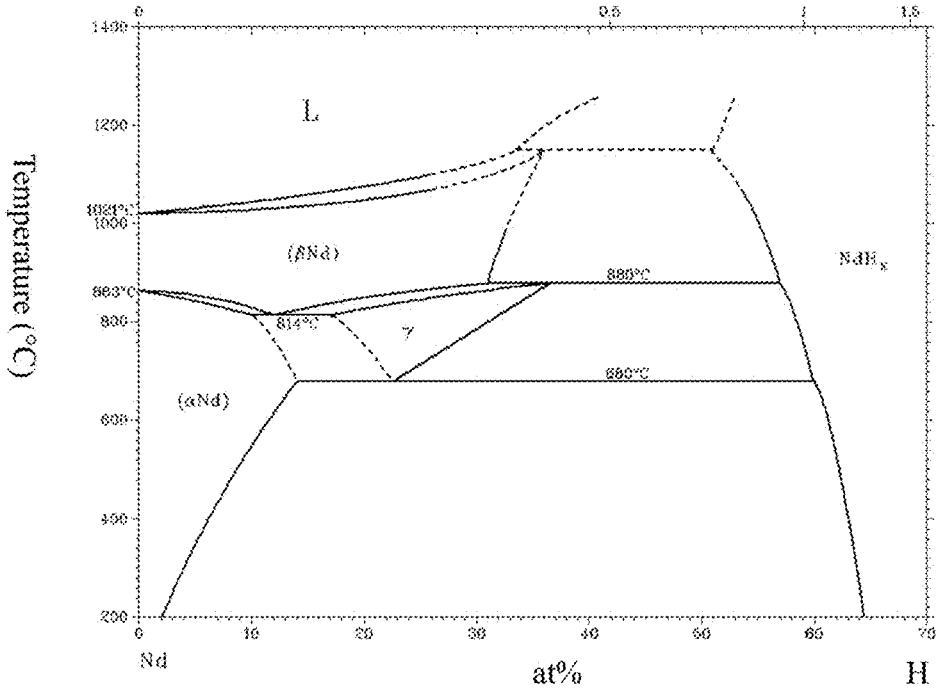
FIG. 5 illustrates a binary phase diagram of Nd—H.

The present invention will be further described in detail in combination with embodiments hereinafter.

Sintered magnets obtained in Embodiments 1-4 are determined by using the following determination methods:

Evaluation process for magnetic performance: the magnetic performance of a sintered magnet is determined by using the NIM-10000H type nondestructive testing system for BH large rare earth permanent magnet from National Institute of Metrology of China.

Determination on attenuation ratio of magnetic flux: the sintered magnet is placed in an environment at 180° C. for 30 minutes; then naturally cooled to room temperature; and then measured for the magnetic flux. The measured magnetic flux is compared with the measured data prior to heating to calculate an attenuation ratio of the measured magnetic flux before and after heating.

Determination on AGG: the sintered magnet is polished in a horizontal direction, and an average number of AGGs per 1 $cm^2$ is obtained; the AGG mentioned in the present invention refers to an abnormally grown grain with a grain size greater than 40 μm.

Average crystalline grain size testing of a magnet: a magnet is photographed after it is placed under a laser metalloscope at a magnifying power of 2000, wherein a detection surface is in parallel with the lower edge of the view field when taking the photograph. During measurement, a straight line with a length of 146.5 μm is drawn at the central position of the view field; and by counting the number of main phase crystals through the straight line, the average crystalline grain size of the magnet is calculated.

Embodiment 1

Preparation process of raw material: Nd with a purity of 99.5%, Pr with a purity of 99.5%, industrial Fe—B, industrial pure Fe, Co with a purity of 99.9%, Cu with a purity of 99.5% and W with a purity of 99.999% were prepared in weight percentage (wt %) and formulated into the raw material.

In order to accurately control the use proportion of W, in this embodiment, the amount of W in the selected Nd, Fe, Pr, Fe—B, Co and Cu was less than a detection limit of existing devices, and a source of W was metal W which was additionally added.

The amounts of the elements are as shown in Table 2.

TABLE 2

| | Proportions of Elements (wt %) | | | | | | |
|---|---|---|---|---|---|---|---|
| No. | Nd | Pr | B | Co | Cu | W | Fe |
| Comparative example 1 | 31.9 | 1 | 0.9 | 1.0 | 0.2 | 0.01 | Balance |
| Embodiment 1.1 | 31.7 | 2 | 0.9 | 1.0 | 0.2 | 0.01 | Balance |
| Embodiment 1.2 | 30 | 5 | 0.9 | 1.0 | 0.2 | 0.01 | Balance |
| Embodiment 1.3 | 22 | 10 | 0.9 | 1.0 | 0.2 | 0.01 | Balance |
| Embodiment 1.4 | 12 | 20 | 0.9 | 1.0 | 0.2 | 0.01 | Balance |
| Embodiment 1.5 | 0 | 32 | 0.9 | 1.0 | 0.2 | 0.01 | Balance |
| Comparative example 1.2 | 12 | 20 | 0.9 | 1.0 | 0.2 | 0 | Balance |

Each number of the above embodiment is respectively prepared according to the element composition in Table 2; and 10 kg of raw materials were then weighted and prepared.

Smelting process: one part of the formulated raw materials was taken and put into a crucible made of aluminum oxide each time, and was subjected to vacuum smelting in a high-frequency vacuum induction smelting furnace under a vacuum of $10^{-2}$ Pa at a temperature below 1500° C.

Casting process: after the vacuum smelting, an Ar gas was introduced into the smelting furnace until the pressure reached 20000 Pa; casting was performed using a single-roller quenching process at a cooling speed of $10^{2}$° C./s-$10^{4}$° C./s to obtain a rapidly quenched alloy; and the rapidly quenched alloy was subjected to a heat preservation treatment at 600° C. for 20 min and then cooled to room temperature.

Hydrogen decrepitation process: a hydrogen decrepitation furnace in which the rapidly quenched alloy was placed was vacuumized at room temperature, and then hydrogen with a purity of 99.5% was introduced into the hydrogen decrepitation furnace to a pressure of 0.1 MPa. After being left for 120 min, the furnace was vacuumized while the temperature was increasing, which was vacuumized for 2 hours at the temperature of 500° C., and then was cooled down, obtaining powder after the hydrogen decrepitation.

Fine grinding process: the specimen obtained after the hydrogen decrepitation was subjected to jet milling in a pulverizing chamber at a pressure of 0.45 MPa in an atmosphere having an oxidizing gas amount less than 200 ppm; obtaining fine powder having an average grain size of 3.10 μm (Fisher Method). The oxidizing gas refers to oxygen or moisture.

Methyl caprylate was added into the powder obtained after the jet milling with an addition amount of 0.2% relative to the weight of the mixed powder, and then was well mixed with the powder using a V-type mixer.

Magnetic field shaping process: the powder in which the methyl caprylate had been added as described above was primarily shaped as a cube having a side length of 25 mm using a right angle-oriented magnetic field shaping machine in an oriented magnetic field of 1.8 T, and was demagnetized after the primary shaping.

In order to prevent the shaped body obtained after the primary shaping from being in contact with air, the shaped body was sealed, and then subjected to a secondary shaping using a secondary shaping machine (isostatic pressure shaping machine).

Sintering process: each of the shaped bodies was transferred to a sintering furnace for sintering, which was sintered under a vacuum of $10^{-3}$ Pa at the temperature of 200° C. for 2 hours and at the temperature of 900° C. for 2 hours, and then sintered at the temperature of 1030° C. Afterwards, an Ar gas was introduced into the sintering furnace until the pressure reached 0.1 MPa, and then the sintered body was cooled to room temperature.

Heat treatment process: the sintered body was subjected to heat treatment in a high-purity Ar gas at a temperature of 500° C. for 1 hour, cooled to room temperature and then taken out.

Processing process: the sintered body obtained after the heat treatment was processed into a magnet with φ of 15 mm and a thickness of 5 mm, with the direction of the thickness of 5 mm being the orientation direction of the magnetic field.

Magnetic performance testing was performed on magnets made of the sintered bodies in Comparative Examples 1.1-1.2 and Embodiments 1.1-1.5 to evaluate the magnetic properties thereof. Evaluation results of the magnets in embodiments and comparative examples are shown in Table 3.

TABLE 3

Performance Evaluation for Magnets in Embodiments and Comparative Examples

| No. | Br (kGs) | Hcj (kOe) | SQ (%) | (BH)max (MGOe) | Attenuation ratio of magnetic flux | AGG (Number) | Average crystalline grain size of magnet (micron) |
|---|---|---|---|---|---|---|---|
| Comparative example 1.1 | 13.5 | 13.8 | 98.6 | 44.9 | 8.8 | 3 | 6.2 |
| Embodiment 1.1 | 14.0 | 15.8 | 99.0 | 46.1 | 2.5 | 0 | 4.9 |
| Embodiment 1.2 | 14.1 | 16.5 | 99.5 | 46.2 | 1.7 | 0 | 4.8 |
| Embodiment 1.3 | 14.1 | 16.8 | 99.6 | 46.1 | 2.4 | 0 | 4.7 |
| Embodiment 1.4 | 14.1 | 17.1 | 99.8 | 46.3 | 3.5 | 1 | 4.6 |
| Embodiment 1.5 | 14.2 | 17.4 | 99.9 | 46.2 | 3.9 | 1 | 4.6 |
| Comparative example 1.2 | 12.8 | 11.3 | 94.7 | 38.5 | 32.6 | 5 | 7.3 |

Throughout the implementation process, the amount of O in the magnets in the comparative examples and the embodiments was controlled to be less than or equal to 2000 ppm; and the amount of C in the magnets in the comparative examples and the embodiments was controlled to be less than or equal to 1000 ppm.

It can be concluded that in the present invention, when the amount of Pr is less than 2 wt %, the goal of comprehensively utilizing rare earth resources cannot be achieved.

The components of the sintered magnet made in Embodiment 1.1 was subjected to FE-EPMA (field emission electron probe microanalysis) detection. Results are as shown in Table 6.

Figure 6:
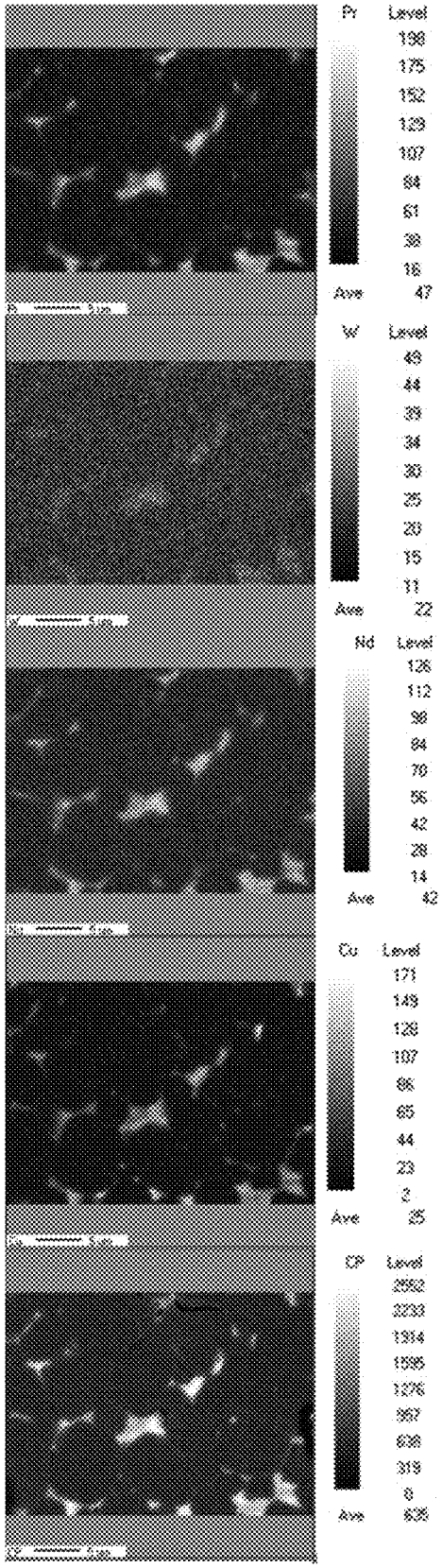
FIG. 6 illustrates EPMA detection results for a sintered magnet according to Embodiment 1.1 of Embodiment 1.

From FIG. 6, it can be seen that R-enriched phases are concentrated towards grain boundaries; the trace amount of W pins the migration of the grain boundaries, adjusts the grain size, and reduces the occurrence of AGG (abnormal grain growth); the coercive force can be uniformly distributed from both microscopic and macroscopic angles; and the heat resistance, thermal demagnetization, and square degree of the magnet are improved.

In Embodiment 1.2 and Embodiment 1.5, the following phenomena were also observed: the R-enriched phases are concentrated towards the grain boundaries, the trace amount of W pins the migration of the grain boundaries, and adjusts the grain size.

After testing, the amounts of the component Pr in the sintered magnets made in Embodiments 1.1, 1.2, 1.3, 1.4, and 1.5 are 1.9 wt %, 4.8 wt %, 9.8 wt %, 19.7 wt %, and 31.6 wt % respectively.

Embodiment 2

Preparation process of raw material: Nd with a purity of 99.9%, Fe—B with a purity of 99.9%, Fe with a purity of 99.9%, Pr with a purity of 99.9%, Cu and Al with a purity of 99.5%, and W with a purity of 99.999% were prepared in weight percentage (wt %) and formulated into the raw material.

In order to accurately control the use proportion of W, in this embodiment, the amount of W in the selected Nd, Fe, Fe—B, Pr, Al, and Cu was less than a detection limit of existing devices, and a source of W was metal W which was additionally added.

The amounts of the elements are shown in Table 4.

TABLE 4

Proportions of Elements (wt %)

| No. | Nd | Pr | B | Cu | Al | Nb | W | Fe |
|---|---|---|---|---|---|---|---|---|
| Comparative example 2.1 | 21 | 10 | 0.85 | 0.8 | 0.2 | 0.2 | 0.0001 | Balance |
| Embodiment 2.1 | 21 | 10 | 0.85 | 0.8 | 0.2 | 0.2 | 0.0005 | Balance |
| Embodiment 2.2 | 21 | 10 | 0.85 | 0.8 | 0.2 | 0.2 | 0.002 | Balance |
| Embodiment 2.3 | 21 | 10 | 0.85 | 0.8 | 0.2 | 0.2 | 0.008 | Balance |
| Embodiment 2.4 | 21 | 10 | 0.85 | 0.8 | 0.2 | 0.2 | 0.03 | Balance |
| Comparative example 2.2 | 21 | 10 | 0.85 | 0.8 | 0.2 | 0.2 | 0.05 | Balance |

Each number of the above embodiment is respectively prepared according to the element composition in Table 4; and 10 kg of raw materials were then weighted and prepared.

Smelting process: one part of formulated raw materials was taken and put into a crucible made of aluminum oxide each time, and was subjected to vacuum smelting in a high-frequency vacuum induction smelting furnace under a vacuum of $10^{-3}$ Pa at a temperature below 1600° C.

Casting process: after the vacuum smelting, an Ar gas was introduced into the smelting furnace until the pressure reached 50000 Pa; casting was performed using a single-roller quenching process at a cooling speed of $10^{2}$° C./s-$10^{4}$° C./s to obtain a rapidly quenched alloy; and the rapidly quenched alloy was subjected to a heat preservation treatment at 500° C. for 10 min and then cooled to room temperature.

Hydrogen decrepitation process: a hydrogen decrepitation furnace in which the rapidly quenched alloy was placed was vacuumized at room temperature, and then hydrogen with a purity of 99.5% was introduced into the hydrogen decrepitation furnace to a pressure of 0.05 MPa. After being left for 125 min, the furnace was vacuumized while the temperature was increasing, which was vacuumized for 2 hours at the temperature of 600° C., and then was cooled down, obtaining powder after the hydrogen decrepitation.

Fine grinding process: the specimen obtained after the hydrogen decrepitation was subjected to jet milling in a pulverizing chamber at a pressure of 0.41 MPa in an atmosphere having an oxidizing gas amount less than 100 ppm; obtaining fine powder having an average grain size of 3.30 μm (Fisher Method). The oxidizing gas refers to oxygen or moisture.

Methyl caprylate was added into the powder obtained after the jet milling with an addition amount of 0.25% relative to the weight of the mixed powder, and then was well mixed with the powder using a V-type mixer.

Magnetic field shaping process: the powder in which the methyl caprylate had been added as described above was primarily shaped as a cube having a side length of 25 mm using a right angle-oriented magnetic field shaping machine in an oriented magnetic field of 1.8 T at a shaping pressure of 0.2 ton/cm$^2$, and was demagnetized after the primary shaping in a magnetic field of 0.2 T.

In order to prevent the shaped body obtained after the primary shaping from being in contact with air, the shaped body was sealed, and then subjected to a secondary shaping using a secondary shaping machine (isostatic pressure shaping machine) at a pressure of 1.1 ton/cm$^2$.

Sintering process: each of the shaped bodies was transferred to a sintering furnace for sintering, which was sintered under a vacuum of $10^{-2}$ Pa at the temperature of 200° C. for 1 hours and at the temperature of 800° C. for 2 hours, and then sintered at the temperature of 1010° C. Afterwards, an Ar gas was introduced into the sintering furnace until the pressure reached 0.1 MPa, and then the sintered body was cooled to room temperature.

Heat treatment process: the sintered body was subjected to heat treatment in a high-purity Ar gas at a temperature of 520° C. for 2 hour, cooled to room temperature and then taken out.

Processing process: the sintered body obtained after the heat treatment was processed into a magnet with φ of 15 mm and a thickness of 5 mm, with the direction of the thickness of 5 mm being the orientation direction of the magnetic field.

Magnetic performance testing was performed on magnets made of the sintered bodies in Comparative Examples 2.1-2.2 and Embodiments 2.1-2.4 to evaluate the magnetic properties thereof. Evaluation results of magnets in the embodiments and the comparative examples are as shown in Table 5.

TABLE 5

Performance Evaluation for Magnets in Embodiments and Comparative Examples

| No. | Br (kGs) | Hcj (kOe) | SQ (%) | (BH)max (MGOe) | Attenuation ratio of magnetic flux (%) | AGG (Number) | Average crystalline grain size of magnet (micron) |
|---|---|---|---|---|---|---|---|
| Comparative example 2.1 | 13.8 | 15.2 | 97.6 | 46.1 | 13.6 | 2 | 6.5 |
| Embodiment 2.1 | 14.2 | 16.8 | 98.5 | 48.5 | 3.7 | 0 | 5.8 |
| Embodiment 2.2 | 14.3 | 17.2 | 99.1 | 48.2 | 1.5 | 0 | 5.7 |
| Embodiment 2.3 | 14.4 | 17.6 | 99.3 | 48.3 | 2.0 | 0 | 5.2 |
| Embodiment 2.4 | 14.3 | 17.8 | 94.9 | 48.1 | 2.5 | 0 | 5.0 |
| Comparative example 2.2 | 12.8 | 14.3 | 95.2 | 39.0 | 35.8 | 7 | 5.8 |

Throughout the implementation process, the amount of 0 in the magnets in the comparative examples and the embodiments was controlled to be less than or equal to 1000 ppm; and the amount of C in the magnets in the comparative examples and the embodiments was controlled to be less than or equal to 1000 ppm.

It can be concluded that when the amount of W is less than 0.0005 wt %, since the amount of W is insufficient, it is difficult to play its role in improving the heat resistance and thermal demagnetization of Pr-containing magnets; and when the amount of W is greater than 0.03 wt %, since amorphous phases and isometric crystals are formed in (the rapidly quenched alloy sheet) SC sheet to cause the saturation magnetization and coercive force of the magnets to be reduced, magnets with high magnetic energy product cannot be obtained.

After testing, the amounts of the component W in the sintered magnets made in Embodiments 2.1, 2.2, 2.3 and 2.4 are 0.0005 wt %, 0.002 wt %, 0.008 wt %, and 0.03 wt % respectively.

Embodiment 3

Preparation process of raw material: Nd with a purity of 99.9%, Fe—B with a purity of 99.9%, Fe with a purity of 99.9%, Pr with a purity of 99.9%, Cu and Ga with a purity of 99.5%, and W with a purity of 99.999% were prepared in weight percentage (wt %) and formulated into the raw material.

In order to accurately control the use proportion of W, in this embodiment, the amount of W in the selected Nd, Fe, Fe—B, Pr, Ga, and Cu was less than a detection limit of existing devices, and a source of W was metal W which was additionally added.

The amounts of the elements are shown in Table 6.

TABLE 6

| Proportions of Elements (wt %) | | | | | | | |
|---|---|---|---|---|---|---|---|
| No. | Nd | Pr | B | Cu | Ga | W | Fe |
| Comparative example 3.1 | 24.5 | 7 | 0.92 | 0.05 | 0.3 | 0.005 | Balance |
| Embodiment 3.1 | 24.5 | 7 | 0.92 | 0.1 | 0.3 | 0.005 | Balance |
| Embodiment 3.2 | 24.5 | 7 | 0.92 | 0.3 | 0.3 | 0.005 | Balance |
| Embodiment 3.3 | 24.5 | 7 | 0.92 | 0.5 | 0.3 | 0.005 | Balance |
| Embodiment 3.4 | 24.5 | 7 | 0.92 | 0.8 | 0.3 | 0.005 | Balance |
| Comparative example 3.2 | 24.5 | 7 | 0.92 | 0.9 | 0.3 | 0.005 | Balance |
| Comparative example 3.3 | 24.5 | 7 | 0.92 | 0.3 | 0.3 | 0 | Balance |

Each number of the above embodiment is respectively prepared according to the element composition in Table 6; and 10 kg of raw materials were then weighted and prepared.

Smelting process: one part of the formulated raw materials was taken and put into a crucible made of aluminum oxide each time, and was subjected to vacuum smelting in a high-frequency vacuum induction smelting furnace under a vacuum of $10^{-2}$ Pa at a temperature below 1450° C.

Casting process: after the vacuum smelting, an Ar gas was introduced into the smelting furnace until the pressure reached 30000 Pa; casting was performed using a single-roller quenching process at a cooling speed of $10^{2}$° C./s-$10^{4}$° C./s to obtain a rapidly quenched alloy; and the rapidly quenched alloy was subjected to a heat preservation treatment at 700° C. for 5 min and then cooled to room temperature.

Hydrogen decrepitation process: a hydrogen decrepitation furnace in which the rapidly quenched alloy was placed was vacuumized at room temperature, and then hydrogen with a purity of 99.5% was introduced into the hydrogen decrepitation furnace to a pressure of 0.08 MPa. After being left for 95 min, the furnace was vacuumized while the temperature was increasing, which was vacuumized for 2 hours at the temperature of 650° C., and then was cooled down, obtaining powder after the hydrogen decrepitation.

Fine grinding process: the specimen obtained after the hydrogen decrepitation was subjected to jet milling in a pulverizing chamber at a pressure of 0.6 MPa in an atmosphere having an oxidizing gas amount less than 100 ppm; obtaining fine powder having an average grain size of 3.3 μm (Fisher Method). The oxidizing gas refers to oxygen or moisture.

Methyl caprylate was added into the powder obtained after the jet milling with an addition amount of 0.1% relative to the weight of the mixed powder, and then was well mixed with the powder using a V-type mixer.

Magnetic field shaping process: the powder in which the methyl caprylate had been added as described above was primarily shaped as a cube having a side length of 25 mm using a right angle-oriented magnetic field shaping machine in an oriented magnetic field of 2.0 T at a shaping pressure of 0.2 ton/cm$^2$, and was demagnetized after the primary shaping in a magnetic field of 0.2 T.

In order to prevent the shaped body obtained after the primary shaping from being in contact with air, the shaped body was sealed, and then subjected to a secondary shaping using a secondary shaping machine (isostatic pressure shaping machine) at a pressure of 1.0 ton/cm$^2$.

Sintering process: each of the shaped bodies was transferred to a sintering furnace for sintering, which was sintered under a vacuum of $10^{-3}$ Pa at the temperature of 200° C. for 2 hours and at the temperature of 700° C. for 2 hours, and then sintered at the temperature of 1020° C. for 2 hours. Afterwards, an Ar gas was introduced into the sintering furnace until the pressure reached 0.1 MPa, and then the sintered body was cooled to room temperature.

Heat treatment process: the sintered body was subjected to heat treatment in a high-purity Ar gas at a temperature of 560° C. for 1 hour, cooled to room temperature and then taken out.

Processing process: the sintered body obtained after the heat treatment was processed into a magnet with φ of 15 mm and a thickness of 5 mm, with the direction of the thickness of 5 mm being the orientation direction of the magnetic field.

Evaluation process for magnetic performance: the magnetic performance of a sintered magnet is determined by using the NIM-10000H type nondestructive testing system for BH large rare earth permanent magnet from National Institute of Metrology of China.

Magnetic performance testing was performed on magnets made of the sintered bodies in Comparative Examples 3.1-3.3 and Embodiments 3.1-3.4 to evaluate the magnetic properties thereof. Evaluation results of the magnets in embodiments and comparative examples are shown in Table 7.

TABLE 7

| Performance Evaluation for Magnets in Embodiments and Comparative Examples | | | | | | | |
|---|---|---|---|---|---|---|---|
| No. | Br (kGs) | Hcj (kOe) | SQ (%) | (BH)max (MGOe) | Attenuation ratio of magnetic flux (%) | AGG (Number) | Average crystalline grain size of magnet (micron) |
| Comparative example 3.1 | 13.8 | 15.7 | 97.8 | 45.5 | 5.6 | 0 | 5.1 |
| Embodiment 3.1 | 14.2 | 16.5 | 98.9 | 47.0 | 2.5 | 0 | 5.1 |
| Embodiment 3.2 | 14.2 | 16.6 | 99.3 | 47.4 | 1.3 | 0 | 5.2 |
| Embodiment 3.3 | 14.2 | 17.0 | 99.5 | 47.8 | 1.8 | 0 | 5.4 |
| Embodiment 3.4 | 14.2 | 16.8 | 99.1 | 47.2 | 2.9 | 0 | 5.3 |
| Comparative example 3.2 | 13.8 | 15.5 | 97.3 | 46.3 | 5.1 | 3 | 6.0 |
| Comparative example 3.3 | 13.8 | 16.1 | 97.7 | 45.2 | 12.7 | 7 | 6.2 |

Throughout the implementation process, the amount of 0 in the magnets in the comparative examples and the embodiments was controlled to be less than or equal to 1500 ppm;

and the amount of C in the magnets in the comparative examples and the embodiments was controlled to be less than or equal to 500 ppm.

It can be concluded that when the amount of Cu is less than 0.1 wt %, SQ is relatively low, which is because Cu can substantively improve SQ; and when the amount of Cu exceeds 0.8 wt %, Hcj and SQ drop. The excessive addition of Cu causes the improving of Hcj to be saturated and other negative factors start to take effect, and thus leading to this phenomenon.

When the amount of Cu is 0.1 wt %-0.8 wt %, Cu dispersed in grain boundaries can effectively facilitate the trace amount of W to play the role in improving the heat resistance and thermal demagnetization performance.

Embodiment 4

Preparation process of raw material: Nd with a purity of 99.8%, industrial Fe—B, industrial pure Fe, Co with purity of 99.9%, and Al and Cr with purity of 99.5% were prepared in weight percentage (wt %) and formulated into the raw material.

In order to accurately control the use proportion of W, in this embodiment, the amount of W in the selected Fe, Fe—B, Pr, Cr, and Al was less than a detection limit of existing devices, the selected Nd comprises W, and the amount of the element W was 0.01% of the Nd amount.

The amounts of the elements are shown in Table 8.

TABLE 8

| Proportions of Elements (wt %) | | | | | | |
|---|---|---|---|---|---|---|
| No. | Nd | Pr | B | Al | Cr | Fe |
| Comparative example 4.1 | 16 | 15.5 | 0.82 | 0.05 | 0.8 | Balance |
| Embodiment 4.1 | 16 | 15.5 | 0.82 | 0.1 | 0.8 | Balance |
| Embodiment 4.2 | 16 | 15.5 | 0.82 | 0.3 | 0.8 | Balance |
| Embodiment 4.3 | 16 | 15.5 | 0.82 | 0.5 | 0.8 | Balance |
| Embodiment 4.4 | 16 | 15.5 | 0.82 | 0.8 | 0.8 | Balance |
| Comparative example 4.2 | 16 | 15.5 | 0.82 | 0.9 | 0.8 | Balance |

Each number of the above embodiment is respectively prepared according to the element composition in Table 8; and 10 kg of raw materials were then weighted and prepared.

Smelting process: one part of formulated raw materials was taken and put into a crucible made of aluminum oxide each time, and was subjected to vacuum smelting in a high-frequency vacuum induction smelting furnace under a vacuum of $10^{-3}$ Pa at a temperature below 1650° C.

Casting process: after the vacuum smelting, an Ar gas was introduced into the smelting furnace until the pressure reached 10000 Pa; casting was performed using a single-roller quenching process at a cooling speed of $10^{2}$° C./s-$10^{4}$° C./s to obtain a rapidly quenched alloy; and the rapidly quenched alloy was subjected to a heat preservation treatment at 450° C. for 80 min and then cooled to room temperature.

Hydrogen decrepitation process: a hydrogen decrepitation furnace in which the rapidly quenched alloy was placed was vacuumized at room temperature, and then hydrogen with a purity of 99.9% was introduced into the hydrogen decrepitation furnace to a pressure of 0.08 MPa. After being left for 120 min, the furnace was vacuumized while the temperature was increasing, which was vacuumized at the temperature of 590° C., and then was cooled down, obtaining powder after the hydrogen decrepitation.

Fine grinding process: the specimen obtained after the hydrogen decrepitation was subjected to jet milling in a pulverizing chamber at a pressure of 0.45 MPa in an atmosphere having an oxidizing gas amount less than 50 ppm; obtaining fine powder having an average grain size of 3.1 μm (Fisher Method). The oxidizing gas refers to oxygen or moisture.

Methyl caprylate was added into the powder obtained after the jet milling with an addition amount of 0.22% relative to the weight of the mixed powder, and then was well mixed with the powder using a V-type mixer.

Magnetic field shaping process: the powder in which the methyl caprylate had been added as described above was primarily shaped as a cube having a side length of 25 mm using a right angle-oriented magnetic field shaping machine in an oriented magnetic field of 1.8 T at a shaping pressure of 0.4 ton/cm$^2$, and was demagnetized after the primary shaping in a magnetic field of 0.2 T.

In order to prevent the shaped body obtained after the primary shaping from being in contact with air, the shaped body was sealed, and then subjected to a secondary shaping using a secondary shaping machine (isostatic pressure shaping machine) at a pressure of 1.1 ton/cm$^2$.

Sintering process: each of the shaped bodies was transferred to a sintering furnace for sintering, which was sintered under a vacuum of $10^{-3}$ Pa at the temperature of 200° C. for 1.5 hours and at the temperature of 970° C. for 2 hours, and then sintered at the temperature of 1030° C. Afterwards, an Ar gas was introduced into the sintering furnace until the pressure reached 0.1 MPa, and then the sintered body was cooled to room temperature.

Heat treatment process: the sintered body was subjected to heat treatment in a high-purity Ar gas at a temperature of 460° C. for 2 hour, cooled to room temperature and then taken out.

Processing process: the sintered body obtained after the heat treatment was processed into a magnet with φ of 15 mm and a thickness of 5 mm, with the direction of the thickness of 5 mm being the orientation direction of the magnetic field.

Magnetic performance testing was performed on magnets made of the sintered bodies in Comparative Examples 4.1-4.2 and Embodiments 4.1-4.4 to evaluate the magnetic properties thereof. Evaluation results of the magnets in examples and comparative examples are shown in Table 9.

TABLE 9

| Performance Evaluation for Magnets in Embodiments and Comparative Examples | | | | | | | |
|---|---|---|---|---|---|---|---|
| No. | Br (kGs) | Hcj (kOe) | SQ (%) | (BH)max (MGOe) | Attenuation ratio of magnetic flux (%) | AGG (Number) | Average crystalline grain size of magnet (micron) |
| Comparative example 4.1 | 13.6 | 17.5 | 96.6 | 44.6 | 4.5 | 1 | 5.2 |

TABLE 9-continued

Performance Evaluation for Magnets in Embodiments and Comparative Examples

| No. | Br (kGs) | Hcj (kOe) | SQ (%) | (BH)max (MGOe) | Attenuation ratio of magnetic flux (%) | AGG (Number) | Average crystalline grain size of magnet (micron) |
|---|---|---|---|---|---|---|---|
| Embodiment 4.1 | 13.8 | 17.9 | 98.5 | 46.8 | 3.5 | 0 | 4.8 |
| Embodiment 4.2 | 13.9 | 18.2 | 99.1 | 47.8 | 1.2 | 0 | 4.7 |
| Embodiment 4.3 | 13.9 | 18.6 | 99.3 | 48.0 | 2.2 | 0 | 4.7 |
| Embodiment 4.4 | 13.8 | 18.9 | 99.2 | 47.2 | 2.6 | 0 | 4.7 |
| Comparative example 4.2 | 13.5 | 17.2 | 95.2 | 43.3 | 7.1 | 3 | 6.5 |

Throughout the implementation process, the amount of 0 in the magnets in the comparative examples and the embodiments was controlled to be less than or equal to 1000 ppm; and the amount of C in the magnets in the comparative examples and the embodiments was controlled to be less than or equal to 1000 ppm.

It can be concluded that from the comparative examples and the embodiments, when the amount of Al is less than 0.1 wt %, since the amount of Al is too low, it is difficult to play its role and the square degree of the magnets is low.

Al with an amount of 0.1 wt %-0.8 wt % and W can effectively facilitate W to play its role in improving the heat resistance and thermal demagnetization performance.

When the amount of Al is greater than 0.8 wt %, excessive Al would cause the Br and square degree of the magnets to drop sharply.

The embodiments described above only serve to further illustrate some particular implementation modes of the present disclosure; however, the present disclosure is not limited to the embodiments. Any simple alternations, equivalent changes, and modifications made to the embodiments above according to the technical essence of the present disclosure will fall within the protection scope of the technical solutions of the present disclosure.

The invention claimed is:

1. A composite R—Fe—B based rare-earth sintered magnet comprising Pr and W, wherein:

the composite R—Fe—B based rare-earth sintered magnet comprises an $R_2Fe_{14}B$ main phase, R is a rare-earth element comprising at least Pr, raw material components of the composite R—Fe—B based rare-earth sintered magnet comprise more than or equal to 2 wt % of Pr, 0.008 wt % to less than 0.03 wt % of W, and 0.8 wt % to 1.3 wt % of B, and the composite R—Fe—B based rare-earth sintered magnet is made through a process comprising:

preparing molten liquid of the raw material components into a quenched alloy;

grinding the quenched alloy into powder;

obtaining a shaped body from the powder by using a magnetic field; and sintering the shaped body.

2. The composite R—Fe—B based rare-earth sintered magnet comprising Pr and W according to claim 1, wherein an amount of Pr is 2 wt %-10 wt % of the raw material components.

3. The composite R—Fe—B based rare-earth sintered magnet comprising Pr and W according to claim 1, wherein R is a rare-earth element comprising at least Nd and Pr.

4. The composite R—Fe—B based rare-earth sintered magnet comprising Pr and W according to claim 1, wherein an amount of oxygen in the composite R—Fe—B based rare-earth sintered magnet is less than or equal to 2000 ppm.

5. The composite R—Fe—B based rare-earth sintered magnet comprising Pr and W according to claim 1, wherein an amount of oxygen in the composite R—Fe—B based rare-earth sintered magnet is less than or equal to 1000 ppm.

6. The composite R—Fe—B based rare-earth sintered magnet comprising Pr and W according to claim 1, wherein the raw material components further comprise less than or equal to 2.0 wt % of at least one additive element selected from the group consisting of Zr, Co, V, Mo, Zn, Ga, Nb, Sn, Sb, Hf, Bi, Ni, Ti, Cr, Si, S, and P, less than or equal to 0.8 wt % of Cu, less than or equal to 0.8 wt % of Al, and the balance of Fe.

7. The composite R—Fe—B based rare-earth sintered magnet comprising Pr and W according to claim 1, wherein:

the quenched alloy is obtained by cooling the molten liquid of the raw material components at a cooling speed of more than or equal to $10^{2\circ}$ C./s and less than or equal to $10^{4\circ}$ C./s by using a strip casting method, grinding the quenched alloy into powder comprises a first grinding and a second grinding, the first grinding comprises performing hydrogen decrepitation on the quenched alloy to obtain first powder, and the second grinding comprises performing jet milling on the first powder to obtain the powder.

8. The composite R—Fe—B based rare-earth sintered magnet comprising Pr and W according to claim 6, wherein an average crystalline particle diameter of the composite R—Fe—B based rare-earth sintered magnet is 2-8 microns.

9. The composite R—Fe—B based rare-earth sintered magnet comprising Pr and W according to claim 6, wherein an average crystalline particle diameter of the composite R—Fe—B based rare-earth sintered magnet is 4.6-5.8 microns.

10. The composite R—Fe—B based rare-earth sintered magnet comprising Pr and W according to claim 6, wherein the raw material components comprise 0.1 wt %-0.8 wt % of Cu.

11. The composite R—Fe—B based rare-earth sintered magnet comprising Pr and W according to claim 6, wherein the raw material components comprise 0.1 wt %-0.8 wt % of Al.

12. The composite R—Fe—B based rare-earth sintered magnet comprising Pr and W according to claim 6, wherein the raw material components comprise 0.3 wt %-2.0 wt % of at least one additive element selected from the group consisting of Zr, Co, V, Mo, Zn, Ga, Nb, Sn, Sb, Hf, Bi, Ni, Ti, Cr, Si, S, and P.

13. The composite R—Fe—B based rare-earth sintered magnet comprising Pr and W according to claim 6, wherein an amount of B is 0.8 wt %-0.92 wt %.

14. The composite R—Fe—B based rare-earth sintered magnet comprising Pr and W according to claim 1, wherein:

the composite R—Fe—B based rare-earth sintered magnet has a residual flux density (Br) of 14.0 kGs to 14.2 kGs, and the composite R—Fe—B based rare-earth sintered magnet has a square degree (SQ) of 99.0% to 99.9%.

15. The composite R—Fe—B based rare-earth sintered magnet comprising Pr and W according to claim 14, wherein a coercive force (Hcj) of the composite R—Fe—B based rare-earth sintered magnet is 15.8 kOe to 17.4 kOe.

16. A composite R—Fe—B based rare-earth sintered magnet comprising Pr and W, wherein:

the composite R—Fe—B based rare-earth sintered magnet comprises an $R_2Fe_{14}B$ main phase, R is a rare-earth element comprising at least Pr, components of the composite R—Fe—B based rare-earth sintered magnet comprise more than or equal to 1.9 wt % of Pr, 0.008 wt % to less than 0.03 wt % of W, and 0.8 wt % to 1.3 wt % of B, and the composite R—Fe—B based rare-earth sintered magnet is made through a process comprising:

preparing molten liquid of raw material components into a quenched alloy, wherein the raw material components comprise the 0.008 wt % to less than 0.03 wt % of W;

grinding the quenched alloy into powder;

obtaining a shaped body from the powder by using a magnetic field; and sintering the shaped body.

17. The composite R—Fe—B based rare-earth sintered magnet comprising Pr and W according to claim 16, wherein the components further comprise less than or equal to 2.0 wt % of at least one additive element selected from the group consisting of Zr, Co, V, Mo, Zn, Ga, Nb, Sn, Sb, Hf, Bi, Ni, Ti, Cr, Si, S, and P, less than or equal to 0.8 wt % of Cu, less than or equal to 0.8 wt % of Al, and the balance of Fe.

* * * * *